US005563638A

United States Patent [19]

Osborne

[11] Patent Number: 5,563,638

[45] Date of Patent: Oct. 8, 1996

[54] INK-JET PRINTHEAD CAPPING AND WIPING METHOD AND APPARATUS

[75] Inventor: William S. Osborne, Vancouver, Wash.

[73] Assignee: Hewlett-Packard Company, Palo Alto, Calif.

[21] Appl. No.: 949,197

[22] Filed: Sep. 21, 1992

[51] Int. Cl.[6] ..... B41J 2/165

[52] U.S. Cl. ..... 347/32; 347/33

[58] Field of Search ..... 346/140 R; 347/32, 347/33, 22, 29, 24

[56] References Cited

U.S. PATENT DOCUMENTS

| | | | |
|---|---|---|---|
| 4,853,717 | 8/1989 | Harmon et al. | 346/140 R |
| 5,027,134 | 6/1991 | Harmon et al. | 346/140 R |
| 5,055,856 | 10/1991 | Tomii et al. | 346/140 R |
| 5,103,244 | 4/1992 | Gast et al. | 347/33 |
| 5,115,250 | 5/1992 | Harmon et al. | 346/140 R |
| 5,252,993 | 10/1993 | Tomii et al. | 346/140 R |
| 5,260,724 | 11/1993 | Tomii et al. | 346/140 R |

FOREIGN PATENT DOCUMENTS

| | | | |
|---|---|---|---|
| 0494674 | 7/1992 | European Pat. Off. . | |
| 0552030 | 7/1993 | European Pat. Off. . | |
| 3528926 | 2/1987 | Germany | 347/29 |
| 58-193157 | 11/1983 | Japan | B41J 3/04 |
| 59-91064 | 5/1984 | Japan | B41J 3/04 |
| 62-111751 | 5/1987 | Japan | B41J 3/04 |
| 3-32848 | 2/1991 | Japan | B41J 2/165 |

OTHER PUBLICATIONS

EP–A–0 398 347 (Canon K. K.); Column 11, Line 17–Column 15, Line 53; Column 19, Line 35–Column 20, Line 16; Column 24, Line 57–Column 25, Line 21; Figs, 8A, 10, 14.

EP–A–0 410 691 (Seiko Instruments Inc.) Column 2, Line 32–Column 4, Line 38; Figs. 1–3.

*Primary Examiner*—Benjamin R. Fuller
*Assistant Examiner*—David Yockey

[57] ABSTRACT

Wiping and capping method and apparatus for use with an ink-jet printer are described. Preferably the apparatus includes a sled that is gimbal-mounted, and preferably spring-mounted, to a printer's chassis, the sled mounting plural pairs of caps and wipers for each of the printer's movable carriage-mounted printheads. The sled and the chassis are cam-coupled for controlled, relative movement therebetween. The sled and the carriage are also cam-coupled for controlled, relative movement therebetween. Movement of the carriage produces slight vertical and lateral movement of the sled out of its nominal position to place it in three primary positions relative to the carriage: an elevated position for capping the printheads, an intermediate position for wiping the printheads and a lowered position for free reciprocal movement of the carriage without interference between the printheads and either the caps or the wipers. Preferably, the gimbal mounting of the sled takes the form of plural spring elements, which ensure constant capping force between the caps and their corresponding printheads. The preferred invented method involves uncapping the printheads, wiping the printheads uni-directionally, lowering the sled to its free position beneath the printheads, optionally re-wiping the printheads repeatedly, and returning the printheads to their capped position. The method and apparatus are compatible with automatic failure recovery techniques to unclog printheads, including spitting and priming.

19 Claims, 5 Drawing Sheets

INK-JET PRINTHEAD CAPPING AND WIPING METHOD AND APPARATUS

BACKGROUND AND SUMMARY OF THE INVENTION

The present invention relates generally to an improved ink-jet printer service method and system. More particularly, the invention concerns a mechanism that includes an improved automatic system for wiping and capping plural printheads that depends upon printer carriage motion and that utilizes uni-directional, separate wiping action for each printhead and capping of each printhead with a constant capping force.

Ink-jet printhead nozzles commonly become plugged with ink blobs or particulate therein, or otherwise contaminated with internal bubbles that prevent them from operating properly. Lower print quality and user complaints often result. Conventional service mechanisms typically provide for the spitting, wiping and capping of single printheads, frequently require operator intervention and often take the printer off-line for several seconds. Wiping an ink-jet printhead in two directions, or wiping multiple printheads with a single wiper surface, results in recontamination of a printhead during wiping or inter-printhead contamination.

Improved capping systems have been proposed that provide for constant-force, rather than constant-deflection, capping of plural printheads in ink-jet printers. One such capping system is described in my co-pending U.S. patent application Ser. No. 07/935,606, entitled "Ink-jet Printhead Cap Having Suspended Lip", which was filed Aug. 26, 1992, and which is commonly owned herewith. The disclosure of that co-pending patent application is incorporated herein by this reference.

Failure recovery methods and systems have been proposed that provide for the automatic recovery from a condition in a plural printhead ink-jet printer in which the printhead's nozzles become clogged with ink and particulate, wherein the method preferably includes capping the printheads, selectively priming and flushing a given printhead and then uncapping and wiping the printheads. One such method and system is described in my co-pending U.S. patent application Ser. No. 07/949,318, entitled "Automatic Failure Recovery for Ink-jet Printheads", which was filed concurrently herewith on Sep. 21, 1992, and which is commonly owned herewith. The disclosure of that co-pending patent application also is incorporated herein by this reference.

The invented method and apparatus preferably include a sled that is gimbal-mounted to a printer's chassis, the sled mounting plural pairs of caps and wipers for each of the printer's movable carriage-mounted printheads. The sled and the chassis are cam-coupled for controlled, relative movement therebetween. The sled and the carriage are also cam-coupled for controlled, relative movement therebetween. Movement of the carriage produces slight vertical and lateral movement of the sled out of its nominal position to place it in three primary positions relative to the carriage: an elevated position for capping the printheads, an intermediate position for wiping the printheads and a lowered position for free reciprocal movement of the carriage without interference between the printheads and either the caps or the wipers. Thus, a controller that includes only the printer's carriage drive motor provides printer servicing, including capping and wiping.

Preferably, capping is under the constant force imparted by the gimbal-mounted sled, which gimbal preferably takes the form of plural spring elements. Preferably, wiping is uni-directional, thereby avoiding recontamination of a printhead during a return swipe. Importantly, there is no permanent lock-out state of the method and apparatus from which printing would not resume without operator intervention. The preferred method involves uncapping the printheads, wiping the printheads uni-directionally, lowering the sled to its free position beneath the printheads, optionally re-wiping the printheads repeatedly, and returning the printheads to their capped position. During the wiping operation, one or more of the printheads also may be spitted to wet the corresponding wiper. The method and apparatus of the invention are compatible with automatic priming of selected ones of the plural printheads.

These and additional objects and advantages of the present invention will be more readily understood after a consideration of the drawings and the detailed description of the preferred embodiment.

Figure 1A:
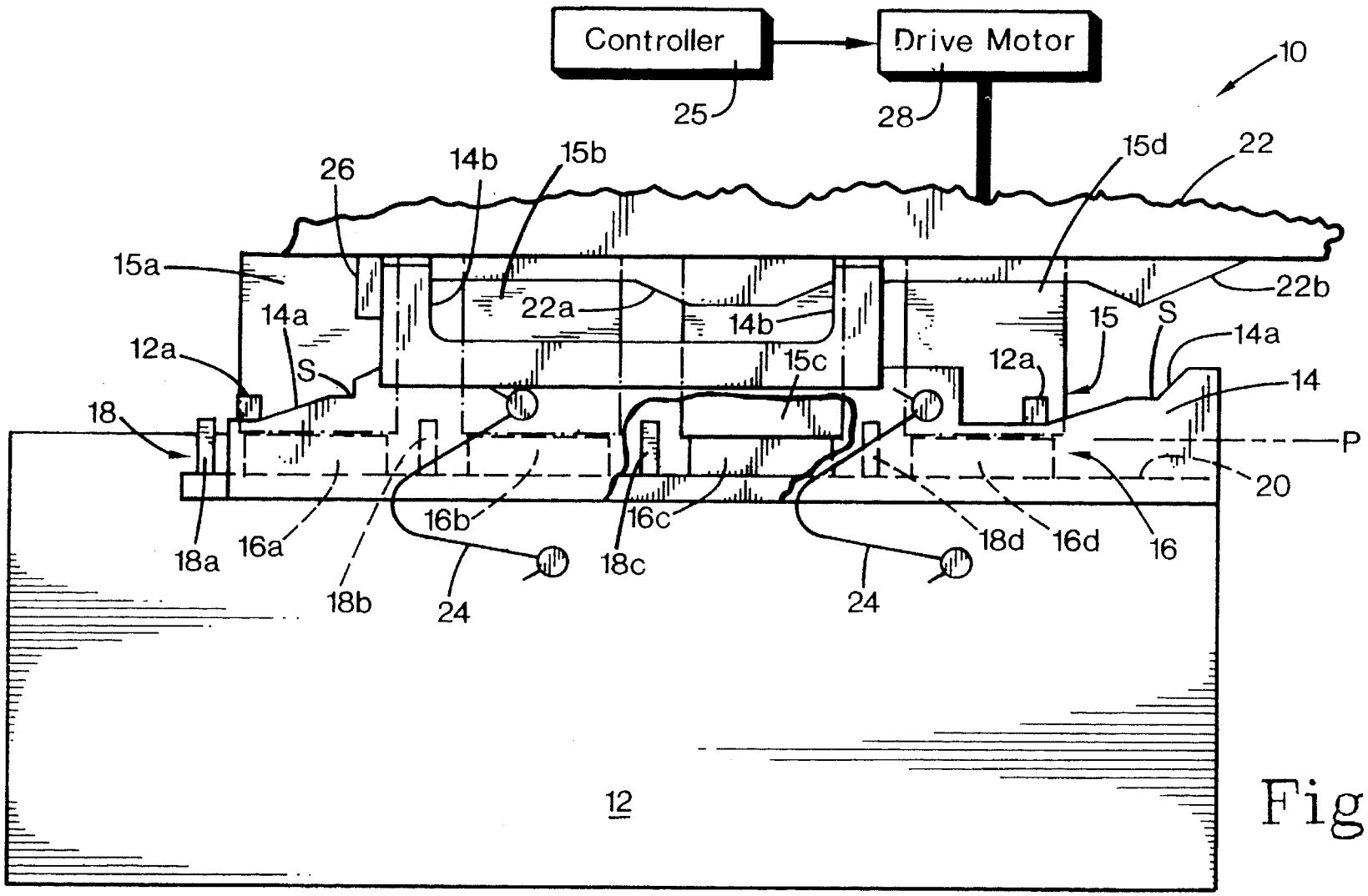
FIG. 1A is a partially schematic fragmented front elevational view.

DETAILED DESCRIPTION OF THE PREFERRED EMBODIMENTS AND BEST MODE OF CARRYING OUT THE INVENTION

FIGS. 1A through 1H illustrate the preferred method and apparatus of the invention in various phases of their operation. It will be appreciated that FIGS. 1A through 1H show, fragmentarily and in greatly simplified form, an ink-jet printer 10 in front elevational view. (It also will be appreciated that, for the sake of clarity, only FIG. 1A carries all referenced numerical designators.) The printer's chassis, or base 12, is shown only fragmentarily and in greatly simplified form. Gimbal-mounted to chassis 12 is a floating sled 14 services an array of one or more printheads 15, here for instance, four printheads 15*a*, 15*b*, 15*c* and 15*d* (shown in FIG. 1A and omitted from FIGS. 1B–1H for clarity). The sled 14 that mounts in a preferably linear array of one or more caps 16 (having printhead-sealing lips at their upper extents), here shown as four caps 16*a*, 16*b*, 16*c* and 16*d*. The sled 14 also mounts one or more wipers 18, here four wipers 18*a*, 18*b*, 18*c* and 18*d* (having upper terminal ends or wiping surfaces. The sled 14 mounts the caps 16 and the wipers 18 on a generally planar support member 20. Sled 14 is positioned beneath the printer's movable carriage 22, which is shown only fragmentarily, which carriage will be understood to mount plural printheads 15*a*, 15*b*, 15*c*, and 15*d* (not shown in FIGS. 1B through 1H) the operative bottom surfaces of which define a first substantially horizontal plane P indicated in FIGS. 1A through 1H as a dashed line.

Each of wipers 18 is operatively associable with a corresponding printhead 15, as is each cap 16. Sled 14, which preferably is gimbal mounted to chassis 12 by plural spring elements 24, may be seen from FIGS. 1A through 1H to be cam-coupled with chassis 12 for controlled relative movement therebetween. Sled 14 also is cam coupled with carriage 22, which mounts the printheads, for controlled relative movement therebetween. As will be seen, this dual cam coupling of sled 14 with relatively fixed chassis 12 and relatively movable carriage 22 produces slight vertical and horizontal, e.g. lateral, movement of sled 14 in response to controlled, reciprocal, horizontal movement of carriage 22 relative to chassis 12. Such reciprocal movement of carriage 22 relative to chassis 12, in accordance with the preferred method and apparatus of the invention, automatically is provided by a carriage controller 25. The controller 25 controls, and may be considered as including, a carriage drive motor 28 operable in common with service and print modes of operation of the printer 10, as described further below.

In a service mode of operation of the printer, cam-coupled sled 14 and chassis 12, and cam-coupled sled 14 and carriage 22, responsive to the controller 25 and movement of carriage 22 undergoes programmed vertical and lateral movement that results in the placement of caps 16 and wipers 18 in predefined uncapping, wiping and recapping positions relative to their corresponding printheads 15. It will be appreciated that the printer carriage's singular drive motor 28 is operated in common with both the service mode described herein and with the normal printing mode of operation of the printer.

Importantly, gimbal-mounting of sled 14 to chassis 12, by way of plural spring elements or members 24, produces a substantially constant force between the printheads 15 and wipers 18 (for wiping), and between the printheads and caps 16 (for capping) by upward forces imparted through sled 14 normal to plane P. Each of spring elements 24 preferably is made of spring steel and is mounted rotatably on one end to a capture post (indicated schematically as a simple circle) on chassis 12 and on the other end to a capture post (identically indicated) on sled 14. Preferably, spring elements 24 are generally V-shaped, as shown, have a nominal angle between their radially extending arms of approximately 31.9° and provide approximately 0.4 pounds of force at 10.4 millimeters (10.4 mm) of compression from their nominal 24.2 mm span.

It will be appreciated that such constant-force capping and wiping reduces wear on the lips of caps 16 and on the upper terminal ends, or wiping surfaces, of wipers 18, which may be brought into frequent contact with the lower planar surfaces of the printheads. No less importantly, such gimbal-mounting with spring elements 24 defines a nominal position of sled 14 and a substantially horizontal plane that is parallel with plane P defined by the lower surfaces of the printheads. Finally, and most importantly, stored energy in spring elements 24 provides the force necessary to urge sled 14 through its various vertical and lateral movements in the elevational plane (shown in FIGS. 1A–1H) that are controlled by the above-described cam-coupling arrangement. Such cam action-controlled horizontal and vertical movement of sled 14 relative to chassis 12 thus requires no external motive force, e.g. a dedicated drive motor, but instead is produced very simply and cost effectively by horizontal movement between carriage 22 and chassis 12.

Referring still to FIGS. 1A through 1H, sled 14 may be seen to include first cam surfaces **14*a* (having predefined, nearly identical profiles, as shown in FIGS. 1A through 1H, where it may be seen that left cam surface 14*a* has a pronounced vertical step defining a temporary stop S whereas right cam surface 14*a* has an inclined corresponding step also defining temporary stop S) engaged with corresponding second cam follower members 12*a* of chassis 12. Sled 14 further may be seen to include first cam follower members 14*b* extending upwardly from sled 14, with first cam follower members 14*b* being engaged with corresponding second cam surfaces 22*a*, 22*b* of carriage 22. Preferably, four such first cam surfaces 14*a* and first cam follower members 14*b* are provided along the perimeter of generally plano-rectangular sled 14, thus to horizontally stabilize sled 14, although for reasons of clarity and brevity only two each are shown in FIGS. 1A through 1H. (Correspondingly, preferably four second cam follower members 12*a* are provided on chassis 12 and two each second cam surfaces 22*a*, 22*b* are provided on carriage 22, although only two and one each respectively are shown in FIGS. 1A through 1H**.)

Preferably, sled 14, including at least cam surfaces **14*a*, is unitary, injection molded from a polymer material having a teflon filler. In order to provide a suitably low coefficient of friction between cam surfaces 14*a* and cam follower members 12*a* of the chassis, preferably cam follower members 12*a*** are same-polymer injection molded parts, but the polymer material preferably has no teflon filler. It has been found that these materials provide for smooth cam action and durability. Obviously, other suitable materials may be used, although of course lightweight, easily and inexpensively manufactured parts are preferred.

Figure 1B:
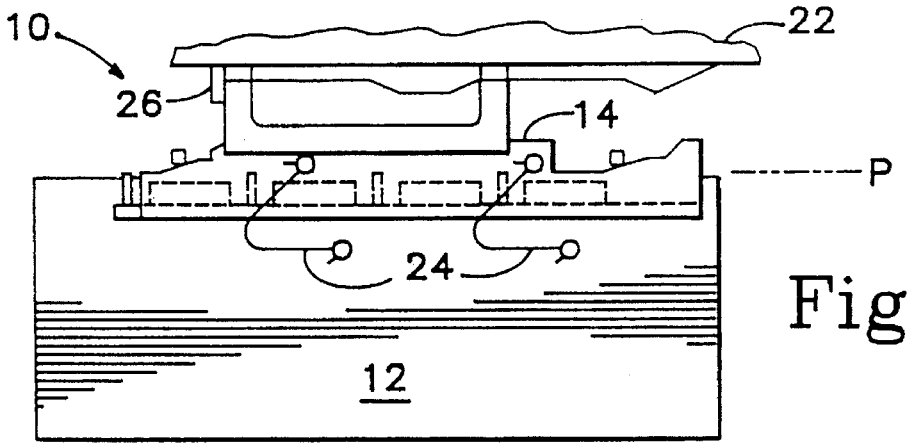
FIGS. 1B through 1H are a series of simplified front elevational views of the ink-jet wiping and capping apparatus, made in accordance with the preferred embodiment of the invention, showing various phases of its operation.

In service operation involving uncapping, wiping and recapping the printheads, the printheads first are uncapped in unison, as may best be seen by contrasting FIGS. 1A and 1B, by relative movement between chassis 12 and sled 14, with first cam surfaces **14*a* of sled 14 and second cam follower members 12*a* of chassis 12 producing substantially vertical downward movement of sled 14 relative to carriage 22, the relative movement between chassis 12 and sled 14 being produced by an end stop member, or end stop, 26 mounted on carriage 12 adjacent an extreme end of second cam surfaces 22*a*, 12*b***.

Thus, FIG. 1A may be seen to illustrate a capping position in which the plane defined by the lower surface of the printheads nominally, but with slight interference fit, is coplanar with the plane defined by the lips of caps 16, whereas FIG. 1B may be seen to illustrate an uncapped position of the printheads in which sled 14 is at an intermediate, wiping position or elevation in which the plane P defined by the printheads nominally, with slight interference fit, is coplanar with a plane defined by the wiping surfaces of wipers 18. By the dual cam action provided between (1) first cam surfaces **14*a* of sled 14 and second follower members 12*a* of chassis 12, and (2) second cam surfaces 22*a*, 22*b* of carriage 22 and first follower members 14*b* of sled 14, no horizontal movement between sled 14 and chassis 22 occurs, but a downward vertical movement of sled 14 relative thereto does occur, thereby to remove sled 14 from a printhead capping to a printhead wiping position. It will be appreciated that this downward vertical movement of sled 14 relative to carriage 22 results from forces imparted on sled 14 by the slight leftward movement of carriage 22 as second follower members 12*a* of chassis 12 urge sled 14 downwardly via an upwardly and rightwardly inclined, left-most region of first cam surfaces 14*a* of chassis 12**.

Figure 1C:
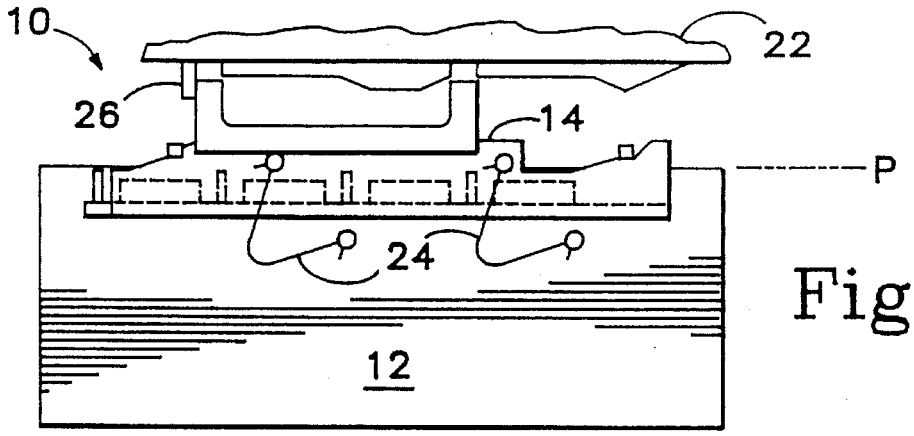
Figure 1D:
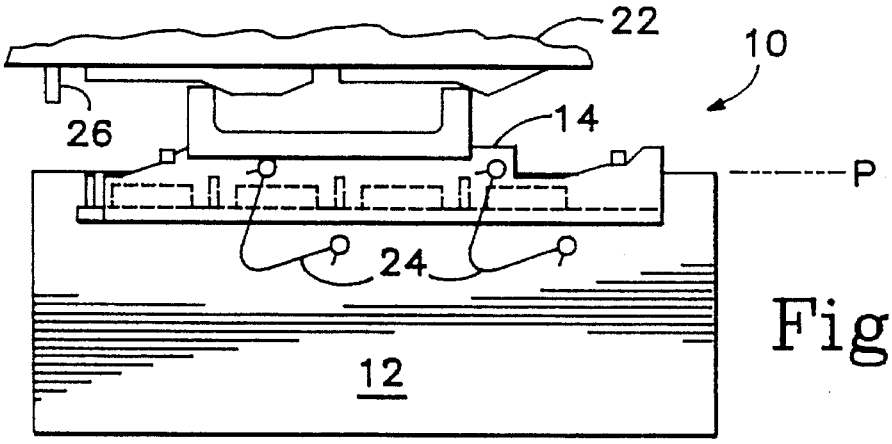

Now contrasting FIGS. 1B and 1C, it may be understood how sled 14 has moved from its uncapped position of FIG. 1B to its start wipe position of FIG. 1C. In FIG. 1C, carriage 12 is slightly further to the left than in FIG. 1B, but it is primarily lesser tension in spring elements 24 (i.e. the fact that spring elements 24 were compressed in the uncapped position of FIG. 1B into a higher energy state) that causes sled 14 to move slightly further left relative to chassis 12 such that second follower members **12*a* thereof reach a temporary stop, indicated as S, approximately half way up inclined first cam surfaces 14*a*. FIGS. 1C and 1D accordingly represent what may be referred to as an equilibrium position of sled 14 relative to chassis 12 in which sled 14 will remain at a predefined wiping elevation relative to carriage 22 until it is urged out of equilibrium by an external force. Accordingly, FIG. 1C represents a start-of-wipe, or begin-wipe, position, and FIG. 1D represents an end-of-wipe position between which the printheads are wiped in unison by substantially horizontal relative movement between carriage 22 and chassis 12**.

Figure 1E:
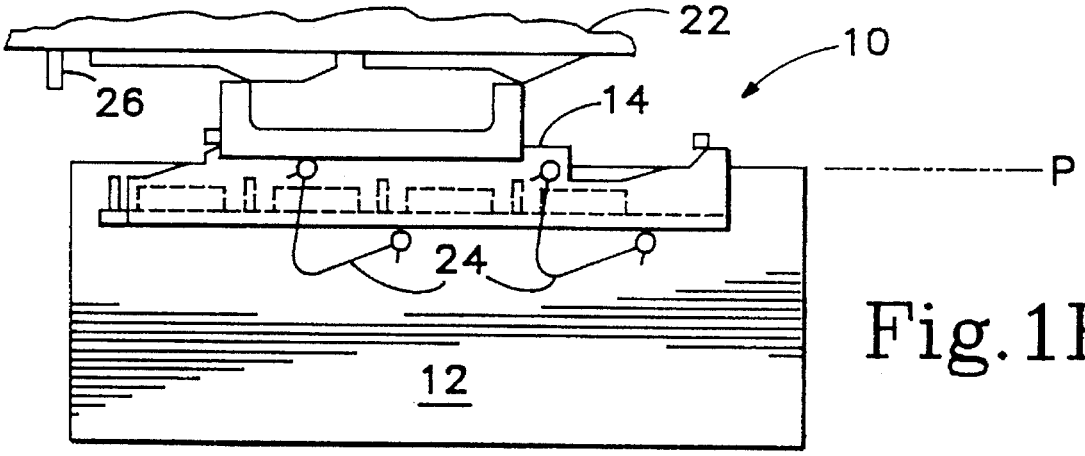

Contrasting now FIGS. 1D and 1E, it may be seen that, at the end of the wiping action in which sled 14 is in the above described equilibrium position, second cam surfaces 22*a*, 22*b* of carriage 22 impact upon first follower members 14*b* of sled 14 to force sled 14 slightly downwardly near the end of the leftward travel of carriage 22. FIG. 1E illustrates a position of sled 14 at which wipers 18 have disengaged from the printheads 15.

Figure 1F:
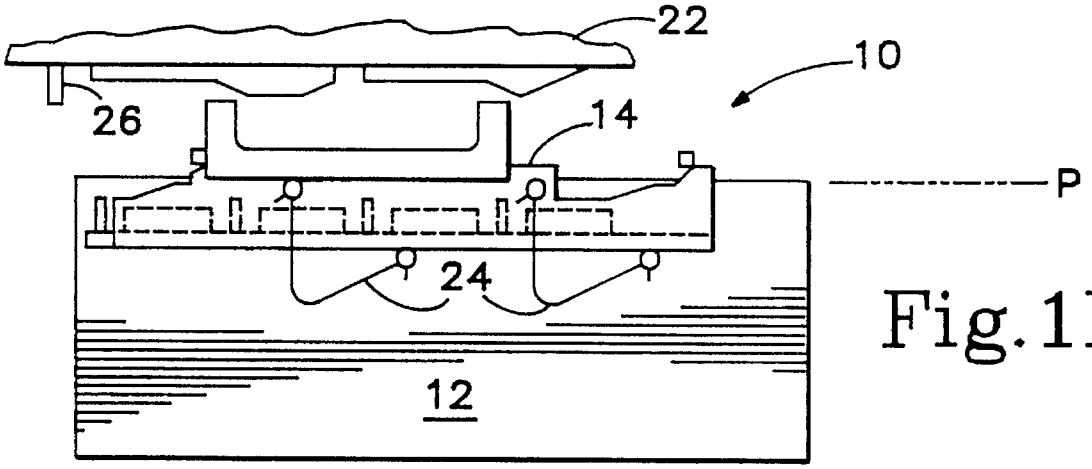
Figure 1G:
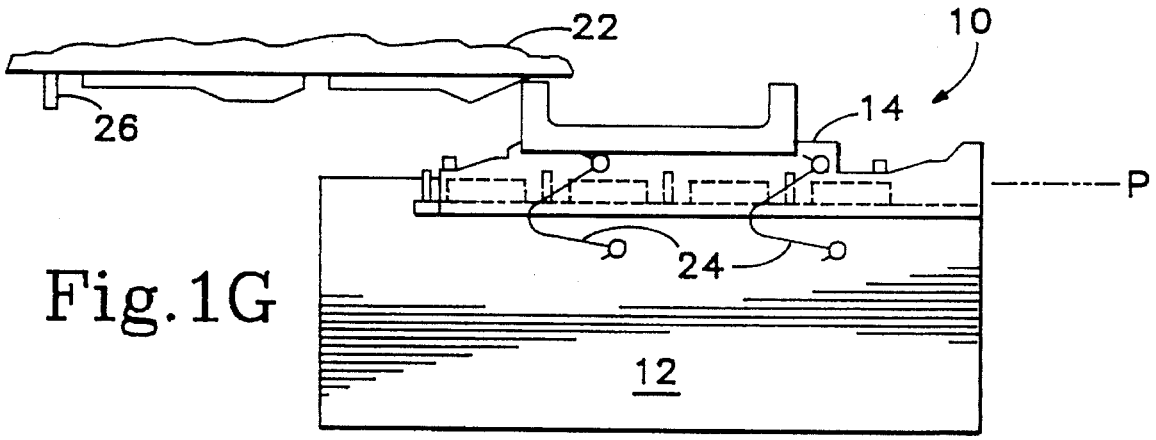
Figure 1H:
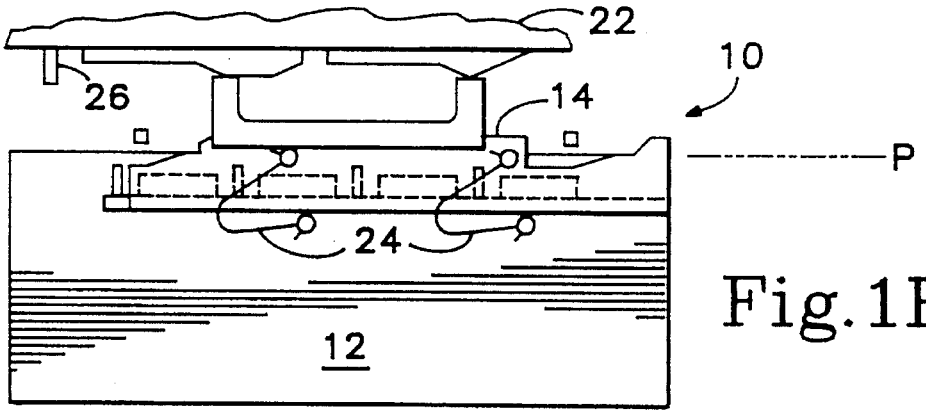

FIG. 1F shows the down position of sled 14 in which carriage 22, freely and without printhead interference with either caps 16 or wipers 18, may be horizontally reciprocated above sled 14. FIG. 1G shows a temporary lockout position of carriage 22 that might be reached by intentional or inadvertent manual intervention by a printer operator or service person. Importantly, second cam surface 22*b* on its extreme right end has a leftwardly, downwardly inclined region that, with first cam follower members 14*b* positioned to the right thereof but moving toward the left, causes sled 14 to settle into a lowered position in which carriage 22 freely may be returned to the right as in the capping position shown in FIG. 1A. It will be understood that spring elements 24 under compression in the position of sled 14 shown in FIG. 1H tend to urge sled 14 into its elevated, printhead-capping position of FIG. 1A as carriage 22 travels toward the right.

Briefly summarizing, it may be seen that relative movement between carriage 22 and base 12 produces downward movement of sled 14 by cam action between first cam surface 14*a* and second follower member 12*a*, the extent of which downward movement is predefined to position the upper terminal ends of wipers 18 in first plane P defined by the lower surfaces of the printheads, thereby to define a wiping position of sled 14. Further relative movement between carriage 22 and base 12 produces wiping action between wipers 18 and the printheads. Still further relative movement therebetween produces further downward movement of sled 14 by cam action between second cam surface 22*a* and first follower member 14*b*, the extent of which is predefined to position the lips of caps 16 and the upper terminal ends of wipers 18 beneath first plane P, thereby defining a free position of sled 14 in which carriage 22 mounting the printheads freely may be reciprocated without interference between the printheads and the lips or between the printheads and the wipers.

Figure 2:
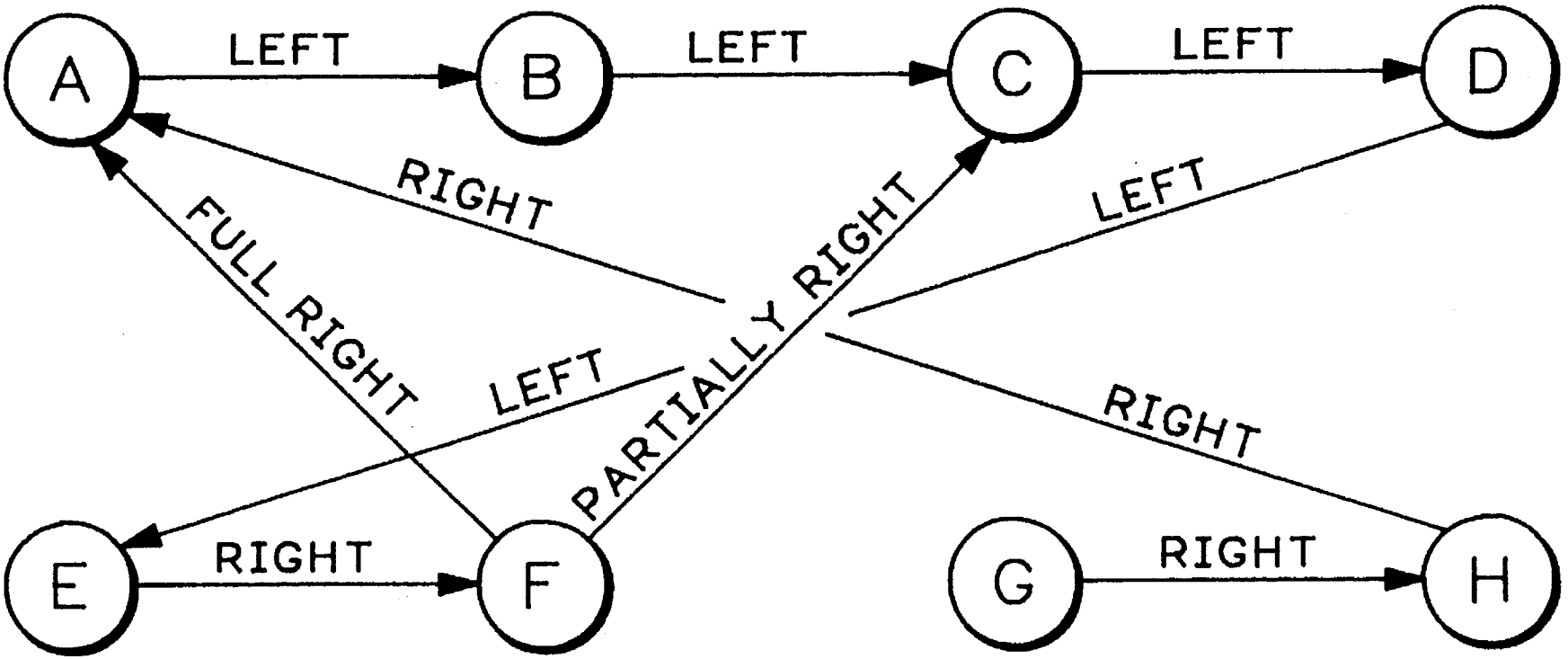
FIG. 2 is a transition diagram corresponding with the operational phases illustrated in FIGS. 1A through 1H.

FIG. 2 is a flow diagram that illustrates the transitions (represented by arrows labelled with the direction of travel of carriage 22 that produces the transition) through which versatile apparatus 10 progresses to reach the various operational phases A through H (represented by circles so-labelled) corresponding, respectively, with FIGS. 1A through 1H. FIG. 2 is thought to be self-explanatory, to those skilled in the art having an understanding of FIGS. 1A through 1H, as described herein. It may be seen from FIG. 2 that the capped or capping position (A) of sled 14 represents the start of the service mode of operation of the ink-jet printer to which the sled may be returned from its down position (F) that normally ends such service mode. Alternatively, when sled 14 is in its down position, it may repeatedly wipe the printheads 15 by transitioning instead to its start-wipe position (C) and indefinitely repeating transitioning through its start-wipe (C), end-wipe (D), disengage-wipe (E) and down (F) positions, as shown.

In the event that the service mode of operation of the printer is manually locked out (G), nevertheless such is only temporary in that sled 14 may be moved to its service position by transitioning through an entering-from-lock-out position (H) by moving carriage 22 to the right as shown. First follower members 14*b* glide along leftwardly, downwardly inclined regions of second cam surfaces 22*a*, 22*b* to return sled 14 to the capped position (A). (It is noted in this connection that the left one of cam follower members 14*b* is made slightly wider than the right one, and that the spaces immediately to the left and right of second cam surface 22*a* also are differently dimensioned, so that left cam follower member 14*b* cannot enter the space between second cam surfaces 22*a*, 22*b* during a transition from the entering-from-lock-out position (H) to the capping position (A).)

It will be appreciated that it is the full or partway extent of rightward carriage travel, as determined by the controller 25, that determines whether sled 14 transitions from its down position (F) to its capping position (A) or to its start-wipe position (C). In other words, carriage 22 is positioned either a first predefined extent of movement after first follower member 14*b* hits end stop 26 in order to place sled 14 in its capping position (A), or a second predefined extent of movement less than the first predefined extent of movement after first follower member 14*b* hits end stop 26, to place sled 14 in its start-wipe position (C).

Skilled persons will appreciate that carriage-mounted end stop member 26 engages first follower member 14*b* to urge sled 14 laterally relative to base 12, in response to rightward movement of carriage 12 by the controller. Thus, with sled 14 in its free position in which carriage 22 freely may be reciprocated thereabove, e.g. its down position (F), and with such first predefined extent of movement by carriage 22, stop member 26 stops first follower member 14*b* thereby producing movement between first cam surface 14*a* and second follower member 12*a* sufficient to elevate sled 14 to a capping position (A) of caps 16 relative to the printheads 15. Alternatively, with sled 14 in such free position and with such second predefined extent of movement, stop member 26 stops follower member 14*b* thereby producing movement between cam surface 14*a* and follower member 12*a* sufficient only to elevate sled 14 to a start-wipe position (C), or simply a wiping position or elevation, of wipers 18 relative to the printheads 15.

The preferred method of the invention now may be understood, in view of the preferred apparatus of the invention. The preferred method of uncapping and wiping an ink-jet printer's printhead 15, wherein the printhead is fixedly mounted on a movable carriage of the printer, includes: (1) providing a sled-mounted wiper selectively engageable with the printhead, e.g. wiper 18 mounted on sled 14; (2) providing the sled with a cam surface, e.g. surface 14*a*, for engaging a corresponding cam follower member, e.g. member 12*a*, mounted on the printer's chassis; (3) spring-mounting such sled on such chassis, e.g. by way of spring elements 24; (4) first moving the carriage horizontally relative to such chassis, thereby producing vertical movement between the sled and the carriage by cam action to uncap the printhead and to position the wiper in a plane defined by the printhead, e.g. controlling the movement of carriage 22 to cause sled 14 and wiper 18 mounted thereon to leave its capping position (A) and to move to its uncapped position (B); (5) second moving the carriage horizontally relative to the chassis, thereby producing horizontal movement of the sled parallel with such plane in such manner that the printhead is wiped by the wiper in a given direction defined by such relative movement, e.g. controlling the movement of carriage 22 from its start-wipe position (C) to its end-of-wipe position (D) to cause sled-mounted wiper 18 to wipe the printhead 15 in the illustrated left-to-right direction; and thereafter (6) lowering the sled to position the wiper below such plane, e.g. into the illustrated down position (F).

Preferably, the method further includes, after the lowering step, (7) third moving the carriage horizontally relative to the chassis to restore the printhead to a capped position, e.g. moving carriage 22 fully to the right such that left follower member **14*b* impacts on stop member 26 to force the sled back into its capped position (A). Optionally, the method may include repeating the second moving step, as illustrated best in FIG. 2** by the directed arrows to operational phases labelled C, D, E, F, C, D, E, F, etc.

While the above preferred method is described as involving the uncapping, capping and optional recapping of a singular printhead, it will be appreciated that, in accordance with the preferred apparatus of the invention, the printer may have plural printheads and plural corresponding wipers, whereby all printheads are uncapped, wiped and capped also in accordance with the preferred method. It will be appreciated that the invented method and apparatus are compatible with printhead spitting, simultaneously with or closely proximate in time with, wiping. It also will be appreciated that the invented method and apparatus are compatible with printhead priming, preferably performed in accordance with my above-referenced automatic failure recovery patent application.

Industrial Applicability

It may be seen then that the invented wiping and capping method and apparatus for ink-jet printers enables automatic servicing of the ink-jet's printheads, providing uni-directional wiping of each printhead by a separate wiper to avoid printhead re-contamination or inter-printhead contamination. Printhead capping, which greatly extends the life of an ink-jet printer, is done preferably under constant force on, rather than under constant deflection of, the caps' sealing lips. Few, relatively simple parts are required and provide a relatively low-cost service solution, while avoiding the cost of additional drive motors. This is made possible by gimbal mounting the sled, which in turn mounts the caps and wipers, to the printer's chassis and by variously positioning the sled by dual cam action between the sled and the chassis and between the sled and the carriage. Controlled reciprocal, horizontal movement of the printer's carriage sequences the sled through its various positions to uncap, wipe, (repeatedly, as needed) and recap the printheads. The invented wiping and capping method require no operator intervention, take the printer off-line for only a second, and automatically restore the printer from its service mode to its printing mode of operation.

While the present invention has been shown and described with reference to the foregoing operational principles and preferred embodiment, it will be apparent to those skilled in the art that other changes in form and detail may be made therein without departing from the spirit and scope of the invention as defined in the appended claims.

I claim:

1. An automatic wiping and capping apparatus for use within a plural printhead inkjet printer having a motor, a chassis with a capture structure and a cam structure, a carriage driven by the motor for lateral reciprocal movement relative to the chassis, with the carriage having a cam structure, and plural printheads mounted on the carriage, comprising:

a sled having a dual cam coupling structure, plural wipers supported by the sled;

plural caps supported by the sled; and a gimbal mounting mechanism including springs, each of said springs being mounted to the sled and engaged with the chassis capture structure so as to gimbal-mount the sled to the printer chassis;

wherein said dual cam coupling structure comprises (1) one member that engages the chassis cam structure when the gimbal mounting mechanism springs engage the chassis capture structure, and (2) another member that engages the carriage cam structure during a portion of the reciprocal movement of the carriage for controlled relative movement of the sled with respect to both the chassis and the carriage that is substantially within a single plane which is substantially parallel to the lateral reciprocal movement of the carriage.

2. The apparatus of claim 1, wherein the gimbal mounting mechanism springs produce a substantially constant force between the printheads and said wipers when said wipers engage the printheads during a wiping operation and a substantially constant force between the printheads and said caps when said caps engage the printheads during a capping operation.

3. The apparatus of claim 1 wherein:

said another member of the sled dual cam coupling structure comprises a first cam surface and said one member of the sled dual cam coupling structure comprises a first cam follower member said chassis cam structure comprising a second can follower member and said carriage cam structure comprising a second cam surface.

4. The apparatus of claim 3, wherein said reciprocal movement include an uncapping portion and said sled first cam surface has a ramped portion that engages the chassis second cam follower member which moves the caps away from the printheads to uncap the printheads in response to the uncapping portion of the reciprocal movement of the carriage.

5. The apparatus of claim 3, wherein said reciprocal movement includes a wiping portion;

the sled first cam surface includes a stop portion that receives the chassis second cam follower member to hold the sled in an equilibrium position; and the wipers wipe the printheads in response to the wiping portion of the reciprocal movement of the carriage when the sled is held in the equilibrium position as the stop portion receives the chassis second cam follower member.

6. A method of uncapping and wiping a printhead of an inkjet printer having a chassis and a carriage supporting the printhead for reciprocal movement relative to the chassis, the method comprising the steps of:

gimbal-mounting a sled on the chassis, the sled having a cap and a wiper each selectively engageable with the printhead, the sled having a cam surface to engage a corresponding cam follower member mounted on the chassis, and a cam follower to engage a cam surface of the carriage;

starting from a capped condition with the sled cap engaging the printhead, first moving the carriage to engage the sled cam surface with the chassis cam follower member to move the cap away from the printhead to uncap the printhead and to position the wiper in a first plane defined by the printhead;

second moving the carriage to secure the sled at an equilibrium position with a wiping surface of the wiper parallel with the first plane and continuing movement of the carriage to wipe the printhead with the wiper; and thereafter third moving the carriage to engage the sled cam follower with the carriage cam surface to position the wiper below the first plane; and after the third moving step:

securing the sled in a print mode position for free reciprocation of the carriage without interference of the printhead with the wiper and cap;

during the print mode of operation, temporarily locking out a service mode of operation by moving the sled to position the wiper in the first plane without engagement of the sled cam follower with the carriage cam surface; and thereafter transitioning back to a service mode of operation for selectively wiping and capping the printhead by moving the carriage in a direction opposite to the movement of the first moving step to engage the sled cam follower with the carriage cam surface.

7. The method of claim 6 which further comprises the step of, after said third moving step, fourth moving the carriage in a direction opposite to the movement of the carriage in the first moving step to restore the printhead to the capped condition.

8. The method of claim 7, wherein said second moving step is repeated after said third moving step and before said fourth moving step to wipe the printhead when uncapped.

9. The method of claim 7, wherein:

said printer has plural printheads supported by the carriage, and said gimbal-mounting step comprises mounting a sled having plural caps and plural wipers selectively engageable with the plural printheads;

the first moving step comprises uncapping the plural printheads;

the second moving step comprises wiping the plural printheads;

the third moving step comprises positioning the plural wipers below the first plane; and the fourth moving step comprises restoring the plural printheads to the capped condition, so the plural printheads are uncapped, wiped and capped in unison in the respective first, second and fourth wiping steps.

10. An inkjet priming mechanism, comprising:

a chassis;

a motor;

a carriage mounted to the chassis and driven by the motor for reciprocal movement relative to the chassis;

plural printheads supported by the carriage, each having a surface lying in a second plane;

a controller which controls the motor to control the carriage movement in a print mode of operation and in a service mode of operation;

a sled gimbal-mounted and cam-coupled to the chassis, the sled also cam-coupled to the carriage during the service mode of operation for movement in a first plane substantially parallel with the reciprocal movement of the carriage, with the sled having a first cam surface and a first follower member;

plural wipers supported by the sled to selectively wipe the plural printheads during a wiping portion of the service mode of operation, with each wiper having a wiping surface; and plural caps supported by the sled to selectively cap and uncap the plural printheads during respective capping and uncapping portions of the service mode of operation, with each cap having a lip to seal the plural printheads when the sled is in a capping position;

wherein the carriage has a second cam surface that engages the sled first follower member during the service mode of operation, and a stop member adjacent said second cam surface to engage the sled first follower;

wherein the chassis has a second follower member that engages the sled first cam surface during the service mode of operation;

wherein the sled moves in the first plane in response to the reciprocal movement of the carriage, with the sled first cam surface having a wipe stop and a free stop both engageable with the chassis second follower member;

wherein during the service mode of operation the sled moves:

(a) from the capping position, away from the printheads by cam action between said first cam surface and said second follower member when the carriage moves and the carriage stop member engages the sled until the wiping surfaces of said wipers are in the second plane to define a wiping position of the sled;

(b) to an equilibrium position with respect to the chassis, where the sled cam surface wipe stop engages the chassis cam follower, so the carriage reciprocal movement wipes the printheads against the wipers; and (c) away from the printheads by cam action between said second cam surface and said first follower member when the carriage moves until the sled cam surface free stop engages the chassis cam follower, where the cap lips and wiping surfaces of said wipers are beyond the second plane to define a free position of the sled in which the carriage freely reciprocates without interference of the printheads with either the caps or the wipers; and (d) when the carriage moves during a portion of the servicing mode of operation, the carriage stop member engages the first follower member to move the sled from the free position to the capping position through relative motion of the first cam surface and the second follower member.

11. An inkjet printing mechanism according to claim 10, wherein the caps and wipers are positioned on the sled such that during the service mode of operation the sled moves in the first plane in response to the reciprocal movement of the carriage to selectively cap, uncap and wipe the plural printheads in unison with the caps and wipers.

12. An inkjet printing mechanism according to claim 11, wherein the sled moves in the first plane into a printing position in response to the reciprocal movement of the carriage during the printing mode of operation.

13. An inkjet printing mechanism according to claim 11, wherein the sled is gimbal-mounted to the chassis by a gimbal-mounting mechanism to engage the sled first follower member with the carriage second cam surface, and to engage the sled first cam surface with the chassis second follower member.

14. An inkjet printing mechanism according to claim 10, wherein the gimbal-mounted sled is mounted to the chassis by plural spring members that impart a substantially constant force through the caps toward the printheads normal to the second plane when the sled is in a capping position.

15. An inkjet printing mechanism comprising:

a chassis having a capture structure and a cam structure;

a motor;

a carriage driven by the motor for lateral reciprocal movement relative to the chassis, with the reciprocal movement comprising an uncapping portion and a wiping portion, and with the carriage having a cam structure;

plural printheads mounted on the carriage;

a printhead servicing sled having a dual cam coupling structure;

plural wipers supported by the sled;

plural caps supported by the sled; and a gimbal mounting mechanism including springs, each of said springs being mounted to the sled and engaged with the chassis capture structure so as to gimbal-mount the sled to the printer chassis;

wherein said dual cam coupling structure comprises (1) one member that engages the chassis cam structure when the gimbal mounting mechanism springs engage the chassis capture structure, and (2) another member that engages the carriage cam structure during a portion of the reciprocal movement of the carriage for controlled relative movement of the sled with respect to both the chassis and the carriage that is substantially within a single plane which is substantially parallel to the lateral reciprocal movement of the carriage.

16. An inkjet printing mechanism according to claim 15, wherein the gimbal mounting mechanism springs produce a substantially constant force between the plural printheads and the plural wipers when said wipers engage the printheads during a wiping operation and a substantially constant force between the plural printheads and the plural caps when said caps engage the printheads during a capping operation.

17. An inkjet printing mechanism according to claim 15, wherein:

said another member of the sled dual cam coupling structure comprises a first cam surface;

said one member of the sled dual cam coupling structure comprises a first cam follower member;

the chassis cam structure comprises a second cam follower member; and the carriage cam structure comprises a second cam surface.

18. An inkjet printing mechanism according to claim 17, wherein said sled first cam surface has a ramped portion that engages the chassis second cam follower member which moves the caps away from the printheads to uncap the printheads in response to the uncapping portion of the reciprocal movement of the carriage.

19. An inkjet printing mechanism according to claim 17, wherein:

the sled first cam surface includes a stop portion that receives the chassis second cam follower member to hold the sled in an equilibrium position; and the wipers wipe the printheads in response to the wiping portion of the reciprocal movement of the carriage when the sled is held in the equilibrium position as the stop portion receives the chassis second cam follower member.

* * * * *